United States Patent [19]

Murphy et al.

[11] 4,007,856

[45] Feb. 15, 1977

[54] APPARATUS FOR DISPENSING WATER AT DIFFERENT TEMPERATURES

[75] Inventors: William V. Murphy, Philadelphia; Charles Walter Albrecht, Warminster, both of Pa.

[73] Assignee: Refreshment Machinery Incorporated, Warminster, Pa.

[22] Filed: July 23, 1975

[21] Appl. No.: 598,514

[52] U.S. Cl. ..... 222/67; 222/108; 222/146 R

[51] Int. Cl.[2] ..... B67D 5/08

[58] Field of Search ..... 222/146 R, 146 C, 146 H, 222/146 HE, 67, 68, 108–110

[56] References Cited

UNITED STATES PATENTS

| | | | |
|---|---|---|---|
| 2,853,208 | 9/1958 | Paulding | 222/146 R |
| 3,069,671 | 12/1962 | Taylor | 222/108 X |
| 3,282,468 | 11/1966 | Karlen | 222/67 |

*Primary Examiner*—Allen N. Knowles
*Attorney, Agent, or Firm*—Seidel, Gonda & Goldhammer

[57] ABSTRACT

Apparatus is disclosed for selectively dispensing heated water, cooled water, or water at ambient temperature. Water under pressure is supplied to a refrigerated reservoir by a water supply pipe having a solenoid operated valve therein. An ambient dispensing valve and a heated water tank having a dispensing valve are each in communication with said water supply pipe at a location between said valve and reservoir.

10 Claims, 2 Drawing Figures

FIG. 1
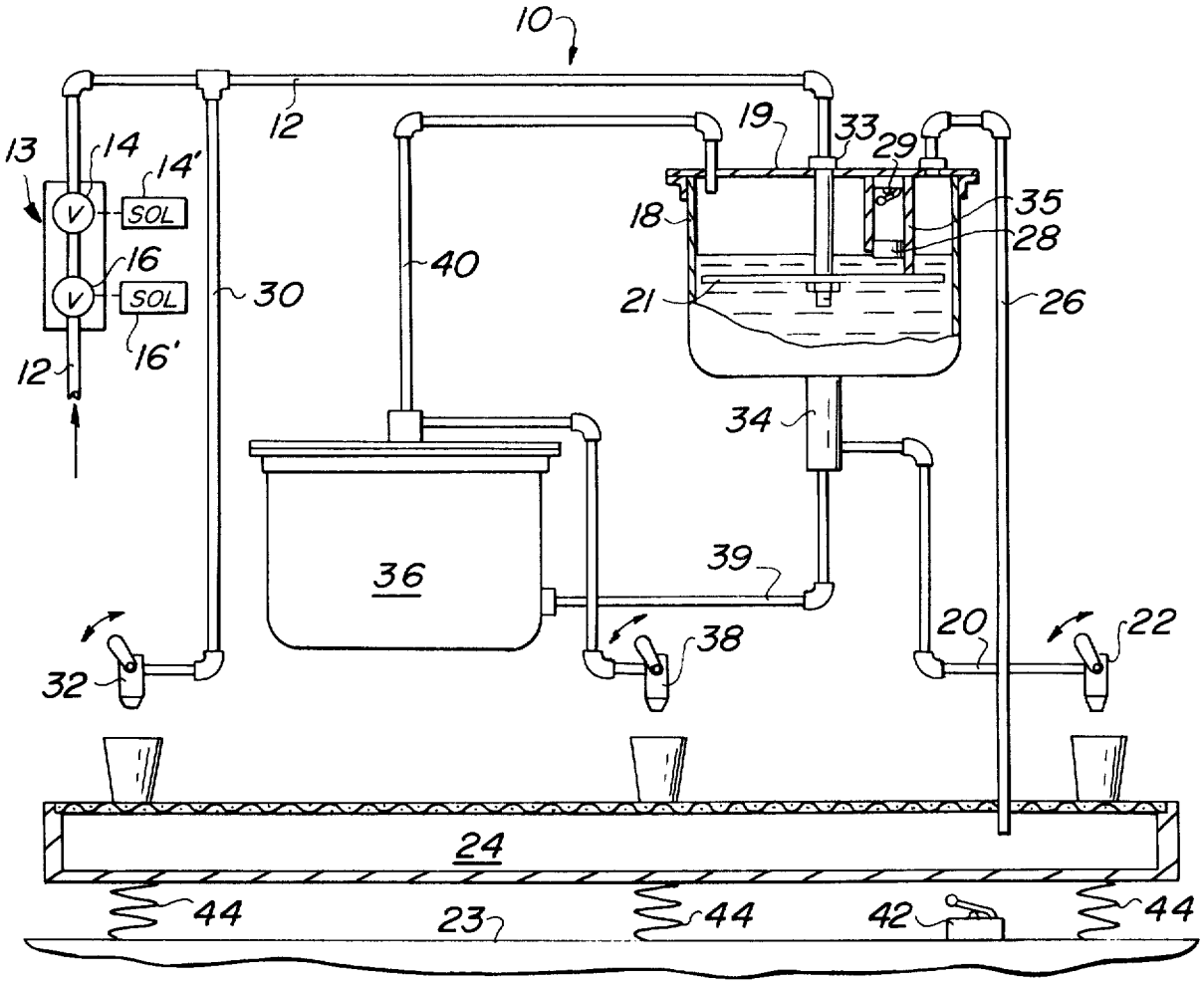
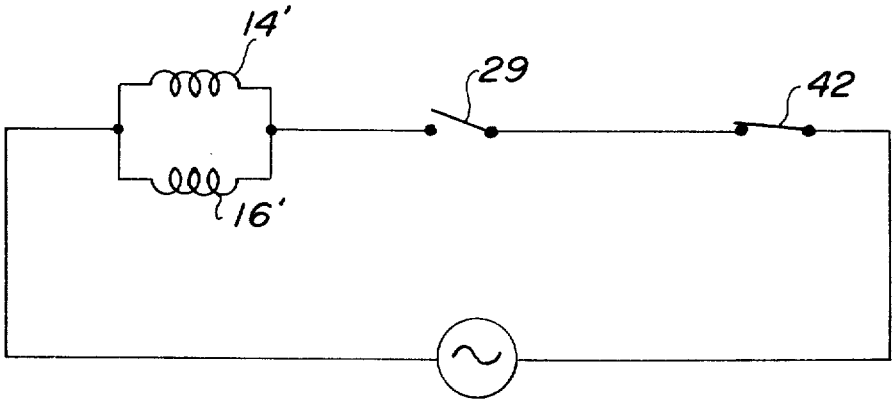
FIG. 2

APPARATUS FOR DISPENSING WATER AT DIFFERENT TEMPERATURES

The apparatus of the present invention is structurally interrelated in a simple manner to facilitate the dispensing of water at three different temperatures with a single water supply conduit for supplying water under pressure. The water supply conduit is provided with a shut-off valve and is connected to a refrigerated reservoir downstream from the shut-off valve. The reservoir is provided with a liquid level detection means coupled to the shut-off valve to open and close the shut-off valve depending upon liquid level in the reservoir.

The apparatus of the present invention includes a dispensing valve connected to an outlet conduit on the refrigerated reservoir for dispensing cold water. An ambient supply conduit is connected to the water supply conduit at a location between said shut-off valve and said reservoir. A dispensing valve is connected to the ambient supply conduit for dispensing water at ambient temperature. A hot water heater tank has an inlet which communicates with the bottom of said reservoir. A dispensing valve is connected to an outlet on said tank for dispensing hot water.

It is an object of the present invention to provide apparatus for dispensing water at three different temperatures with only a single shut-off valve in a water supply conduit, and wherein the apparatus is not connected to a drain.

It is another object of the present invention to provide apparatus for dispensing water at three different temperatures in a manner which is simple, inexpensive, easy to maintain, and can be located in a variety of locations due to the fact that it does not include a drain.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 illustrates a diagrammatic representation of the apparatus of the present invention.

FIG. 2 illustrates electrical circuitry.

Referring to the drawing in detail, wherein like numerals indicate like elements; there is shown in the drawing vending or dispensing apparatus in accordance with the present invention, designated generally as 10.

The apparatus 10 includes a water supply conduit 12 containing a valve 13. The valve 13 preferably is located within housing 23 and includes solenoid operated valve members 14 and 16 in series within a single valve housing. The use of two solenoid operated valve members in series within a single valve housing is a precautionary measure so that if one solenoid operated valve member such as valve member 14 malfunctions, the second valve member 16 will still shut off the supply of water. The solenoids are designated 14' and 16', respectively.

Downstream from the valve 13, the conduit 12 has a portion connected to a refrigerated reservoir 18. Water from conduit 12 enters the reservoir 18 through a distributor pipe 33 and a removable cover 19. Pipe 33 supports a stationary baffle plate 21 and has radial exit ports above the plate 21. Baffle plate 21 prevents the incoming water from creating turbulence in reservoir 18 below the baffle plate 21.

Cold water is dispensed from the reservoir 18 by way of outlet conduit 20 terminating in a dispensing valve 22. A drip tray 24 having a perforated top is spring biased upwardly from housing 23 of the apparatus 10 in a location below the dispensing valve 22. The spring is designated 44.

Within the reservoir 18, there is provided a liquid level detection means comprising a tube 35 containing a switch 29 and a float 28 for controlling switch 29. Float 28 is guided by tube 35 for vertical movement and is disposed at an elevation above the elevation of the baffle plate 21 so as to be less susceptible to undesirable swirling movement of water which would inadvertently cause the float 28 to close the normally open switch 29. It has been found that without tube 35 undesired opening and closing of switch 29 will occur when the reservoir is jarred thereby causing substantial movement of the water in the reservoir. The lower end of tube 35 is open. Tube 35 has a vent hole just below cover 19 and above switch 29.

Reservoir 18 has an overflow conduit 26 which communicates with a drip tray such as drip tray 24. An ambient water conduit 30 communicates with the supply conduit 12 between the valve 13 and the reservoir 18. Conduit 30 is provided with a dispensing valve 32 positioned above said drip tray 24 for dispensing water at ambient temperatures.

A hot water heater tank 36 communicates at its lower end with a supply conduit 39 which extends from coupling 34. Hot water tank 36 is provided with a dispensing valve 38 communicating with the upper end thereof. Valves 22, 32 and 38 are disposed above a drip tray 24. The upper end of the tank 36 is vented by way of conduit 40 to the reservoir 18 above the water level therein. It will be noted that each of the dispensing valves 22 and 38 is at an elevation below the elevation of the reservoir 18 whereby the water head of the reservoir 18 will force water out one or both of valves 22 or 38 when either one or both of the latter are opened.

The drip tray 24 is provided with a normally closed switch 42. Switch 42 is in series with the float operated switch 29 and the coils 14' and 16' of the solenoid valves 14 and 16. Switch 42 is responsive to the weight of water in the drip tray 24 after the weight of the water compresses the spring 44.

The apparatus 10 may be used as follows. The components illustrated in the drawing are mounted in a common housing or cabinet with the dispensing valves 22, 32 and 38 being at a common elevation below the elevation of the reservoir 18. Water supply conduit 12 is connected to a source of water under pressure such as a city water line.

Let it be assumed that the drip tray 24 is empty and that the reservoir 18 has a sufficient quantity of water therein as illustrated whereby the switch 29 is held open by the float 28. Cold water may be dispensed from the reservoir 18 by way of dispensing valve 22 into a container. If sufficient cold water is withdrawn from reservoir 18, the float 28 will descend toward the elevation of the plate 21 and thereby permitting switch 29 to close. When switch 29 closes, a circuit is completed to the solenoid coils 14' and 16' of valve 13 which open and permit water from supply conduit 12 to enter the reservoir 18 at an elevation below the elevation of the baffle plate 21. As soon as the water level in the reservoir 18 returns to the elevation shown so as to be slightly above plate 21, float 28 will open switch 29 thereby closing valve 13.

If there is a malfunction of the switch 29 whereby it does not open under the influence of float 28, the incoming water will exit from the reservoir 18 by way of the overflow conduit 26 into the drip tray 24. When the water level in drip tray 24 reaches a predetermined weight as a result of water introduced thereinto from conduit 26 or overflow from the dispensing valves, the weight of the water in the drip tray 24 compresses spring 44 and opens switch 42 thereby breaking the electrical circuit for the solenoids of valve 13.

If water at ambient temperature is desired, it may be obtained by opening dispensing valve 32. The water within conduit 30 and the portion of the water supply conduit 12 between valve 13 and reservoir 18 remains therein due to atmospheric pressure exerted on the water in reservoir 18. As the water from conduit 30 exits through the dispensing valve 32, it creates a siphoning action which siphons water out of reservoir 18. The removal of water from reservoir 18 lowers the liquid level therein whereby the descent of the float 28 permits switch 29 to close and valve 13 to open. The incoming water under pressure downstream from valve 13 exits through the valve 32. Closure of valve 32 stops dispensing of water and reservoir 18 is refilled until float 28 opens switch 29 to thereby close valve 13.

The hot water tank 36 is always in communication with the water supply in reservoir 18. Any expansion generated in the hot water tank 36 is communicated directly to the space above liquid level in reservoir 18 by way of expansion conduit 40. Opening of valve 38 permits dispensing of hot water. Dispensing of hot water initiates a drop of water level in reservoir 18 thereby causing valve 13 to open as described above. Closure of valve 38 stops dispensing of water and reservoir 18 is refilled until float 28 opens switch 29 to thereby close valve 13.

Thus, it should be apparent that the apparatus 10 is simple, inexpensive to manufacture, easy to maintain, and may be installed in any desirable area so long as there is a supply of water under pressure without requiring a drain. It will be noted that the electrical circuitry and plumbing is simple with the minimum number of control valves and switches.

The present invention may be embodied in other specific forms without departing from the spirit or essential attributes thereof and, accordingly, reference should be made to the appended claims, rather than to the foregoing specification as indicating the scope of the invention.

I claim:

1. Dispensing apparatus comprising a water supply conduit for supplying water under pressure, at least one valve in said conduit, a refrigerated reservoir, said conduit being connected to said reservoir downstream from said valve, a liquid level detection means in said reservoir and connected to said valve to open and close said valve depending upon liquid level in said reservoir, a dispensing valve connected to an outlet conduit on said reservoir for dispensing cold water, an ambient supply conduit connected to said water supply conduit at a location between said at least one valve and said reservoir, a dispensing valve connected to said ambient supply conduit for dispensing water at ambient temperature, a hot water heater tank having an inlet communicating with said water supply conduit downstream from said at least one valve and by way of said reservoir, and a dispensing valve connected to an outlet on said tank for dispensing hot water.

2. Apparatus in accordance with claim 1 wherein said ambient water dispensing valve and said hot water dispensing valve are disposed at an elevation below the elevation of said reservoir.

3. Apparatus in accordance with claim 1 wherein a drip tray is below each dispensing valve, said reservoir having an overflow conduit communicating at one end with said drip tray, said at least one valve being an electrically operated valve having an electrical coil in series with a switch associated with said drip tray whereby the weight of water in the drip tray can interrupt the circuit to said coil.

4. Apparatus in accordance with claim 1 wherein said hot water heater tank is connected to an outlet on said reservoir, said hot water heater tank being connected at its upper end to the reservoir at a location above the elevation of water therein by way of a conduit for venting expansion from the tank to the upper portion of the reservoir.

5. Dispensing apparatus comprising a water supply conduit for supplying water under pressure, at least one valve of said conduit, a refrigerated reservoir, a baffle plate in said reservoir, said water supply conduit communicating with said reservoir at an elevation below said baffle plate, said conduit being connected to said reservoir downstream from said valve, a liquid level detection means in said reservoir disposed above said baffle and connected to said valve to open and close said valve depending upon liquid level in said reservoir, said liquid level detection means including a float operated switch; said valve being an electrically operated valve having a coil in series with said switch, a dispensing valve connected to an outlet conduit on said reservoir for dispensing cold water, an ambient supply conduit connected to said water supply conduit at a location between said at least one valve and said reservoir, a dispensing valve connected to said ambient supply conduit for dispensing water at ambient temperature, a hot water heater tank having an inlet communicating with said water supply conduit downstream from said at least one valve, and a dispensing valve connected to an outlet on said tank for dispensing hot water.

6. Apparatus for dispensing water at different temperatures without having a drain associated therewith comprising a water supply conduit for supplying water under pressure, an electrically operated valve in said conduit, a refrigerated reservoir, a portion of said conduit downstream from said valve being connected to said reservoir, a liquid level detection means in said reservoir and electrically connected to said valve for opening and closing said valve as a function of liquid level in said reservoir, a cold water dispensing valve connected to said reservoir for dispensing cold water therefrom, a second conduit having one end connected to said conduit portion, a dispensing valve communicating with the other end of said second conduit to facilitate dispensing of water at a temperature above the temperature of the water in said reservoir, said last mentioned dispensing valve being disposed at an elevation below the elevation of said reservoir and communicating with said reservoir by way of said conduit portion, a drip tray associated with each dispensing valve and being provided with a switch which is normally closed, said drip tray switch being arranged to open as a function of the weight of water within said drip tray, said electrically operated valve and liquid level detection means being electrically coupled in series with said drip tray switch.

7. Apparatus in accordance with claim 6 wherein said liquid level detection means includes a normally opened electrical switch, means associated with said reservoir for interrupting the electrical circuit to said electrically operated valve in the event that said liquid level switch malfunctions and fails to close when the liquid level in said reservoir reaches a predetermined level, said last mentioned means including an overflow conduit communicating at one end with the upper end portion of said reservoir and at its other end with said drip tray.

8. Apparatus in accordance with claim 6 including a hot water heater tank connected to said reservoir, a hot water dispensing valve communicating with said tank, said drip tray being beneath said last mentioned dispensing valve.

9. Apparatus in accordance with claim 8 wherein said tank and cold water dispensing valve communicate with a single outlet on said reservoir.

10. Apparatus in accordance with claim 6 wherein said conduit portion and said second conduit are free from a flow control valve other than the dispensing valves associated therewith.

* * * * *